US006940990B2

(12) United States Patent
Huang

(10) Patent No.: US 6,940,990 B2
(45) Date of Patent: Sep. 6, 2005

(54) MULTI-CHANNEL AUDIO CENTER SPEAKER DEVICE

(76) Inventor: Wan-Fang Huang, No. 2, Alley 181, Ching-Cheng Road, Chang Hua City (TW)

( * ) Notice: Subject to any disclaimer, the term of this patent is extended or adjusted under 35 U.S.C. 154(b) by 178 days.

(21) Appl. No.: 10/617,774

(22) Filed: Jul. 14, 2003

(65) Prior Publication Data

US 2005/0013454 A1 Jan. 20, 2005

(51) Int. Cl.[7] ..... H04R 25/00; H04R 1/02

(52) U.S. Cl. ..... 381/335; 381/186; 381/351; 181/145; 181/199

(58) Field of Search ..... 381/333–335, 381/306–307, 349–351, 388, 186; 181/144–145, 199

(56) References Cited

U.S. PATENT DOCUMENTS 3,582,553 A * 6/1971 Bose ..... 381/89
4,006,311 A * 2/1977 Carlsson ..... 381/300
4,051,919 A * 10/1977 Buettner ..... 181/144
4,119,799 A * 10/1978 Merlino ..... 381/349
4,122,315 A * 10/1978 Schroeder et al. ..... 381/186
4,266,092 A * 5/1981 Barker, III ..... 381/305
4,451,928 A * 5/1984 Murayama ..... 381/86
4,884,655 A * 12/1989 Freadman et al. ..... 181/145
6,243,477 B1 * 6/2001 Ruiz ..... 381/351
6,719,090 B2 * 4/2004 Tracy ..... 181/145
6,778,675 B2 * 8/2004 Maruo ..... 381/335

* cited by examiner

*Primary Examiner*—Curtis Kuntz
*Assistant Examiner*—Phylesha L Dabney
(74) *Attorney, Agent, or Firm*—Troxell Law Office, PLLC

(57) ABSTRACT

This invention discloses a multi-channel audio center speaker device that has a low-frequency sound box working together with a mid-frequency sound box each on both sides, and the low-frequency sound box works with a high-frequency sound box having a forward sound direction and a mid-frequency sound box having a backward sound direction, and both sound boxes are tilted up to an appropriate angle such that after the sound frequencies are mixed, the audio image provided by the sound frequency of the mixed sound is extended backward through the mid/high frequency speaker, and then the image at the back is reflected to the audience in the front, such that the position of placing the center sound box becomes more flexible, and produces a sound together with the simulated video screen at the back. In the meantime, the present invention can reduce or eliminate the impact of the sound being acted directly on the audience to prevent uneasiness and broaden the range of the multi-channel audio sound.

1 Claim, 2 Drawing Sheets

MULTI-CHANNEL AUDIO CENTER SPEAKER DEVICE

BACKGROUND OF THE INVENTION

1. Field of the Invention

This invention relates to an improved multi-channel audio center speaker device, more particularly to a multi-channel audio speaker device having a low-frequency sound box, two left and right mid-frequency sound boxes, a high-frequency sound box, and a mid-frequency sound box. A wind cavity is disposed on the back of the low-frequency sound box at a position corresponding to the speaker; an assisting wind hole is disposed individually on both sides of the back of the low-frequency sound box; a low-frequency assisting wind cavity is respectively disposed under the external and internal sides of the low-frequency sound box; a mid-frequency sound box is installed individually on both sides of the low-frequency sound box; a plurality of assisting wind holes are disposed around the periphery of the mid-frequency sound box; a wind hole is disposed at a position corresponding to the center of the back of the mid-frequency speaker; a mid-frequency sound box and a high-frequency sound box tilted to an appropriated angle are disposed respectively on the low-frequency sound box, such that the vibration of the speaker will discharge the air in the sound box from the wind cavities and wind holes to work together with the mid-frequency speakers on both sides to produce sounds with a broader range. In such arrangement by tilting the mid/high-frequency speaker backward, after the sound frequencies are mixed, the mixed frequency will be located at the upper rear section of the center speaker and the sound is reflected forward in order to extend and reflect the sound produced by the center speaker and avoid the sound from directly impacting the audience and producing uncomfortable pressure, and further produce the sound effect simulated by the actual environment.

2. Description of the Related Art

In general, a traditional multi-channel audio usually has a left channel and a right channel. To integrate a video effect to an audio effect just like the simulation of the actual theater, a center channel is placed between the left and right channels for a better audio visual effect of a performance or a play. However, a center channel is set under the video screen, and is designed in a rectangular shape transversally disposed, or a tripod is used to heighten the sound box, so that the sound frequency of the center channel can be produced at a position proximate the video screen. However, such sound frequency faces the audience directly; if the sound is too loud, it will produce an uncomfortable impact to the audience. Furthermore, the sound is produced under the video screen, it is impossible to produce a visual sound effect or simulate the effect of producing sound from the video, which is definitely a major shortcoming. In addition, a general horizontal center speaker sound box has limitations on its low-frequency effect and gives a low performance on the sound effect.

SUMMARY OF THE INVENTION

The objective of this invention is to provide a sound effect for a center multi-channel audio speaker to enhance its effect and function, wherein a mid-frequency sound box is installed individually on both sides of the low-frequency sound box, and a mid-frequency sound box and a high-frequency sound box tilted to an appropriate angle are respectively installed above the low-frequency sound box, so that the sound direction of the mid/high frequency has the effect of driving the sound to be mixed and reflecting the sound wave from the video screen at the back to the audience in the front. The distance for placing the center sound box is flexible, which also attains the purpose of simulating the sound effect and producing the sound from the video screen in order to enhance echo functions of its sound range and simulate the actual environment without producing uneasiness to the audience.

To improve the sound vision and sound effect of the multi-channel audio center speaker device and broaden the sound range, so that the sound is clearer and softer without producing uneasiness or incorrect strange sound, a wind cavity and a wind hole are set at an appropriate position in front of and behind the low-frequency and high-frequency sound boxes; a wind cavity or a wind hole is set at a position corresponding to the center of the back of the speaker. A plurality of assisting wind holes are set on the side of the mid-frequency sound box to produce the amplifying effect for the released space when the sound air in the sound box is vibrated to produce sound in the speaker.

To make it easier for our examiner to understand the objective of the invention, its structure, innovative features, and performance, we use a preferred embodiment together with the attached drawings for the detailed description of the invention.

BRIEF DESCRIPTION OF THE DRAWINGS

Other features and advantages of the present invention will become apparent in the following detailed description of the preferred embodiments with reference to the accompanying drawings, in which.

DETAILED DESCRIPTION OF THE PREFERRED EMBODIMENTS

Figure 1:
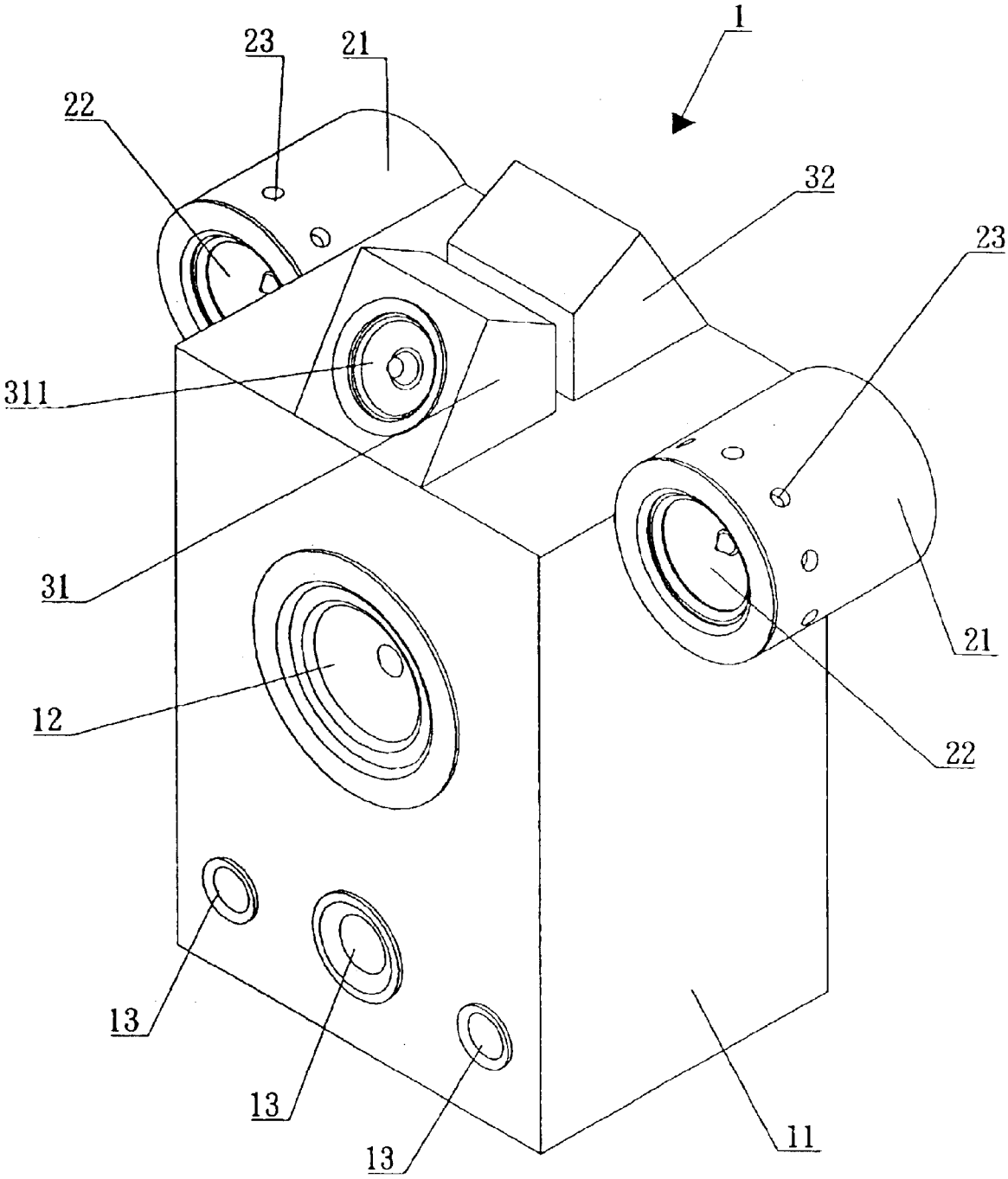
FIG. 1 is a perspective diagram of the improved multi-channel audio center speaker device of the present invention.
Figure 2:
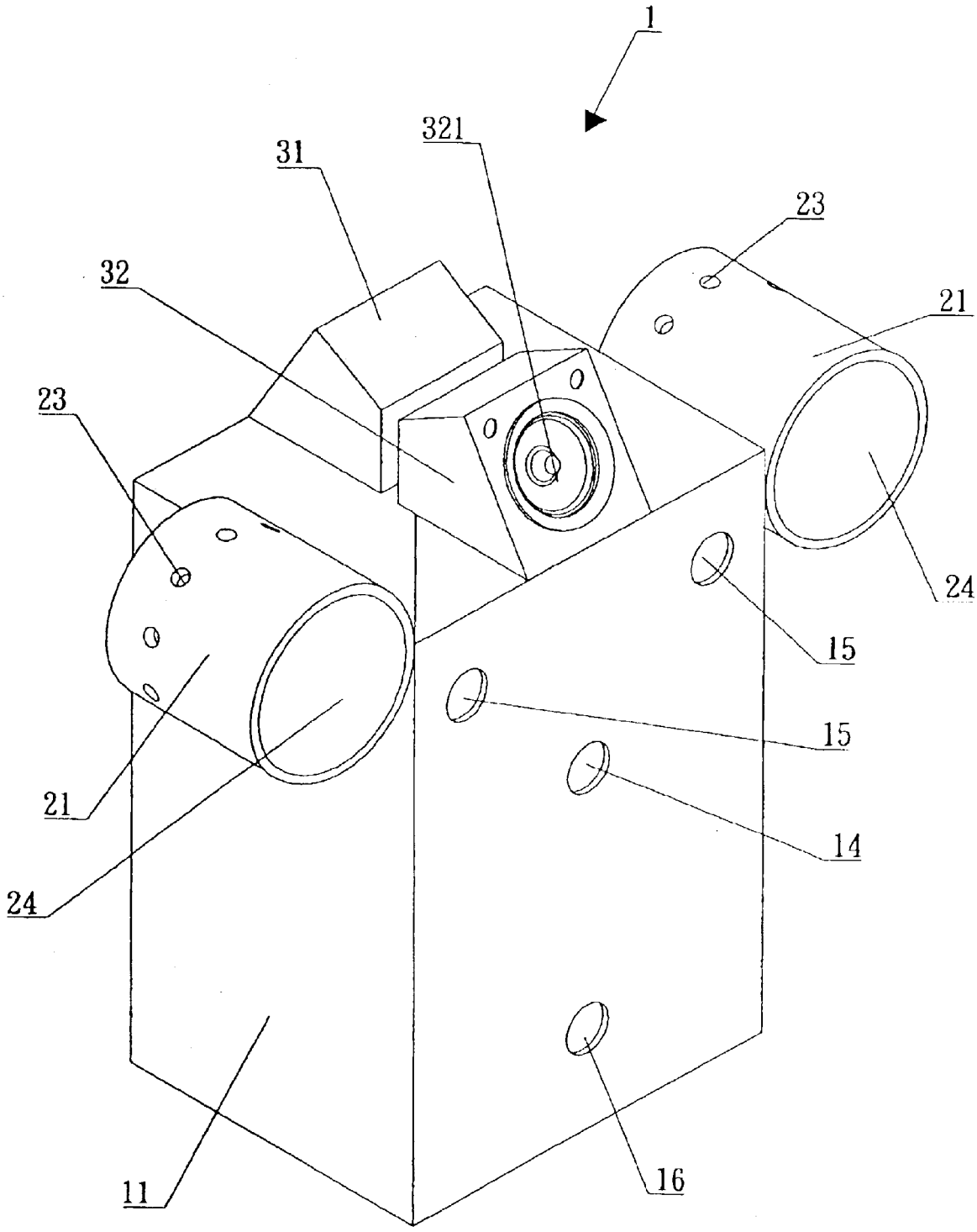
FIG. 2 is a rear-view diagram of FIG. 1.

Referring to FIGS. 1 and 2 for a preferred embodiment of the low-frequency sound box 11 of a center speaker sound box 1, a plurality of wind cavities 13 are disposed under a low-frequency speaker 12; a center wind hole 14 is disposed at the center of the low-frequency speaker 12 corresponding to the center of the back of the low-frequency sound box 11. An upper wind hole 15 is disposed above both sides of the center wind hole 14, and a lower wind hole 16 is disposed below both sides such that when the low-frequency speaker 12 vibrates, the air in the low-frequency sound box 11 will be squeezed and discharged from each wind hole 14, 15, 16, and some part of the sound will be dispersed and spread out from the foregoing wind holes 14, 15, 16 to broaden the sound range and avoid the sound from directly impacting the hearing and producing uneasiness to the audience.

A mid-frequency sound box 21 is installed individually on both sides of the low-frequency sound box 11, wherein a plurality of wind holes 23 are disposed around the rear end of the mid-frequency speaker 22 and a center wind hole is disposed at the center of the mid-frequency speaker 22 corresponding to the center of the back of the mid-frequency sound box 21. When the mid-frequency speaker 22 produces vibrations, it will press on the sound air in the mid-frequency sound box 21 to discharge the sound air from each wind hole 23, 24 and give a broader range of sound to prevent resonance of the sound box as well as loss of originality of the sound.

Further, a high-frequency sound box 31 and a mid/high-frequency sound box 32 respectively have a front and a rear sound directions above the low-frequency sound box 11 such that the sound direction of the front high-frequency speaker 311 faces the audience, and the mid/high-frequency speaker plays backward to focus the sound direction of the low-frequency sound, mid-frequency sound, and high-frequency sound towards the focus at the upper rear section of any position on the center sound box 1. If a projecting screen is disposed on such upper rear section, then the sound will be produced as if it is from the video screen or simulated from the actual environment, as well as providing a broader sound range and eliminating the pressure and uneasiness to the audience.

Therefore, this invention has the following functions and features:

1. It gives a multi-channel sound effect even when a single channel is used only.
2. It offers a broader sound range and a deeper sound image. When the volume is turned up, it will not produce confusion but can give a better low-frequency sound extension effect.
3. Since the sound air is discharged backward, and the mid/high-frequency structure produces sound towards the upper rear section to focus the sound image at the upper rear section, and thus working together with the image to produce a simulated on-the-spot and actual feeling.
4. It allows a more flexible distance to place the horizontal multi-channel audio speaker and does not require a tripod or a stand to heighten the speaker.
5. The speaker in accordance with this invention can be set at a distance far from the TV screen to avoid electromagnetic interference.
6. It is easy to move and installed flexibly.
7. This invention can be used independently for various occasions such as a speech or a karaoke.

In view of the description above, this invention uses a front high-frequency speaker on the center sound box and an upper rear mid/high-frequency speaker to work together with the wind cavities and wind holes of the mid-frequency sound box and low-frequency sound box to transfer the sound image to the upper rear section of the center sound box and accomplish the simulation of the actual environment and eliminate the uneasiness of the pressure.

While the present invention has been described in connection with what is considered the most practical and preferred embodiment, it is understood that the invention is not limited to the disclosed embodiments but is intended to cover various arrangements included within the spirit and scope of the broadest interpretation and equivalent arrangements.

What is claimed is:

1. An improved multi-channel audio center speaker device, comprising a low-frequency sound box, a mid-frequency sound box, a med/high frequency sound box, and a high-frequency sound box; characterized in that:

a low-frequency sound box, having a plurality of wind cavities disposed under its low-frequency speaker, a center wind cavity at the center of said low-frequency speaker corresponding to the center of the back of the low-frequency sound box, an upper wind cavity and a lower wind cavity respectively disposed on both sides of the upper and lower sections of said center wind cavity;

a mid-frequency sound box, being installed on both sides of said low-frequency sound box, and having a plurality of wind holes around the rear end of the mid-frequency speaker, and a center wind hole being disposed at the center of the mid-frequency speaker corresponding to the center of the back of the mid-frequency sound box;

a mid/high frequency sound box and a high-frequency sound box, disposed above the low-frequency sound box, wherein said high-frequency sound box being installed along the front sound direction and the mid/high-frequency sound box being installed along the back sound direction, and both being lilted to an appropriate angle;

thereby, the sound direction of said front high-frequency speaker facing the audience, and the rear mid/high-frequency sound box playing backward to focus the low-frequency sound, high-frequency sound, and mid/high-frequency sound towards the upper rear section according to the sound direction, and extending to the upper rear section of any position on the center sound box and focusing on the focus of the upper rear section; if the rear end being a projection screen, then said sound simulating the actual environment to produce sound from said video screen, providing a broader sound range, and eliminating the pressure and uneasiness to the audience.

* * * * *